US009599345B2

(12) United States Patent
McAfee et al.

(10) Patent No.: US 9,599,345 B2
(45) Date of Patent: Mar. 21, 2017

(54) CROSS HEATING THERMOCOUPLE BASED PAN SENSING

(71) Applicant: Electrolux Home Products, Inc., Charlotte, NC (US)

(72) Inventors: Gerald Wayne McAfee, White House, TN (US); Aric Hanz Storck, Ashland City, TN (US)

(73) Assignee: ELECTROLUX HOME PRODUCTS, INC., Charlotte, NC (US)

( * ) Notice: Subject to any disclaimer, the term of this patent is extended or adjusted under 35 U.S.C. 154(b) by 416 days.

(21) Appl. No.: 14/219,331

(22) Filed: Mar. 19, 2014

(65) Prior Publication Data

US 2014/0295357 A1 Oct. 2, 2014

Related U.S. Application Data

(60) Provisional application No. 61/805,640, filed on Mar. 27, 2013.

(51) Int. Cl.
*F24C 3/12* (2006.01)
*H05B 6/12* (2006.01)

(52) U.S. Cl.
CPC ..... *F24C 3/124* (2013.01); *F24C 3/126* (2013.01); *H05B 6/12* (2013.01)

(58) Field of Classification Search
USPC ..... 431/6, 12; 126/39 G
See application file for complete search history.

(56) References Cited

U.S. PATENT DOCUMENTS 2,903,890 A * 9/1959 Wagner ..... F24C 3/126 126/39 G
2,934,957 A * 5/1960 Reinhart ..... F24C 3/126 126/39 G
4,394,565 A * 7/1983 Dills ..... H05B 3/683 219/433

(Continued)

FOREIGN PATENT DOCUMENTS

CN 1374477 A 10/2002
CN 101743776 A 6/2010

(Continued)

OTHER PUBLICATIONS

International Search Report issued in Application No. PCT/US2014/031194 dated Jul. 17, 2014.

(Continued)

*Primary Examiner* — Avinash Savani
(74) *Attorney, Agent, or Firm* — Pearne & Gordon LLP

(57) ABSTRACT

A cooktop includes a first burner and a second burner. A first temperature sensor is adjacent the first burner, and a second temperature sensor is adjacent the second burner. A cooktop controller is operatively connected to the first temperature sensor to receive a first temperature signal from the first temperature sensor, and operatively connected to the second temperature sensor to receive a second temperature signal from the second temperature sensor. The cooktop controller is configured to determine, from the second temperature signal, an absence of a cooking vessel at the first burner, and to automatically downwardly adjust a heat output of the first burner based on the absence of a cooking vessel at the first burner.

20 Claims, 4 Drawing Sheets

(56) References Cited

U.S. PATENT DOCUMENTS

| | | | | |
|---|---|---|---|---|
| 4,492,336 | A * | 1/1985 | Takata | A47J 27/62 126/39 G |
| 4,499,368 | A * | 2/1985 | Payne | F24C 3/126 219/432 |
| 4,645,124 | A | 2/1987 | Alluto et al. | |
| 5,947,370 | A | 9/1999 | Rona et al. | |
| 6,184,501 | B1 | 2/2001 | Zapf | |
| 6,462,316 | B1 | 10/2002 | Berkcan | |
| 6,554,197 | B2 | 4/2003 | Marbach et al. | |
| 6,663,009 | B1 | 12/2003 | Bedetti et al. | |
| 7,255,100 | B2 | 8/2007 | Repper et al. | |
| 8,065,998 | B2 | 11/2011 | Espina et al. | |
| 2002/0070211 | A1* | 6/2002 | Berkcan | H05B 3/746 219/502 |
| 2010/0132692 | A1 | 6/2010 | Shaffer | |
| 2012/0285948 | A1* | 11/2012 | Shan | H05B 6/062 219/660 |

FOREIGN PATENT DOCUMENTS

| | | | |
|---|---|---|---|
| JP | 2000193251 | A | 7/2000 |
| KR | 2009-0087302 | A | 8/2009 |
| WO | 2009/011994 | A1 | 1/2009 |

OTHER PUBLICATIONS

Written Opinion issued in Application No. PCT/US2014/031194 dated Jul. 17, 2014.

Office action issued in corresponding Chinese Patent Application No. 2014800182188 dated Nov. 1, 2016, 11 pages (including translation).

* cited by examiner

CROSS HEATING THERMOCOUPLE BASED PAN SENSING

CROSS-REFERENCE TO RELATED APPLICATIONS

Benefit of U.S. Provisional Patent Application Ser. No. 61/805,640 filed Mar. 27, 2013, is hereby claimed and the disclosure incorporated herein by reference.

BACKGROUND

Field of the Disclosure

The present disclosure relates to a method and apparatus for detecting the presence of a cooking vessel on a cooktop, and in particular for detecting the presence of a cooking vessel on an active burner on the cooktop.

Description of Related Art

It is known to detect the presence of a cooking vessel at a burner on a cooktop. This can be done by switch that is operated by the weight of the cooking vessel on the burner. However, installing such switches on a cooktop increases the cost and complexity of the appliance. It would be desirable to determine the presence or absence of a cooking vessel at a burner using already-existing hardware on the cooktop.

BRIEF SUMMARY

The following summary presents a simplified summary in order to provide a basic understanding of some aspects of the devices and methods discussed herein. This summary is not an extensive overview of the devices and methods discussed herein. It is not intended to identify critical elements or to delineate the scope of such devices and methods. Its sole purpose is to present some concepts in a simplified form as a prelude to the more detailed description that is presented later.

In accordance with one aspect, provided is a cooktop that includes a first burner and a second burner. A first temperature sensor is adjacent the first burner, and a second temperature sensor is adjacent the second burner. A cooktop controller is operatively connected to the first temperature sensor to receive a first temperature signal from the first temperature sensor, and operatively connected to the second temperature sensor to receive a second temperature signal from the second temperature sensor. The cooktop controller is configured to determine, from the second temperature signal, an absence of a cooking vessel at the first burner, and to automatically downwardly adjust a heat output of the first burner based on the absence of a cooking vessel at the first burner.

In accordance with another aspect, provided is a cooktop that includes a first gas burner and a second gas burner. A first temperature sensor is adjacent the first gas burner, and a second temperature sensor is adjacent the second gas burner such that the second temperature sensor is closer to the second gas burner than the first gas burner. The cooktop includes a first cooking vessel support for supporting a cooking vessel at the first gas burner. A first gas valve controls a first gas flow through the first gas valve to the first gas burner. A first valve actuator is operatively connected to the first gas valve and is configured to adjust the first gas flow through the first gas valve. A programmable cooktop controller is operatively connected to the first temperature sensor to receive a first temperature signal from the first temperature sensor, operatively connected to the second temperature sensor to receive a second temperature signal from the second temperature sensor, and operatively connected to the first valve actuator to control operations of the first valve actuator. The programmable cooktop controller is programmed to determine a presence of a flame at the first gas burner from a level of the first temperature signal, determine a presence of a flame at the second gas burner from a level of the second temperature signal, determine an absence of a cooking vessel at the first gas burner from the level of the second temperature signal, and automatically downwardly adjust the first gas flow to the first gas burner based on the absence of a cooking vessel at the first gas burner.

In accordance with another aspect, provided is a cooktop burner control method. The method includes activating a first burner of the cooktop. A first temperature signal is received from a first temperature sensor adjacent the first burner. A second temperature signal is received from a second temperature sensor, the second temperature sensor being remote from the first burner. Whether a cooking vessel is absent from the first burner is determined based on a level of the second temperature signal. A heat output of the first burner is automatically downwardly adjusted, based on an absence of a cooking vessel from the first burner.

DETAILED DESCRIPTION

Figure 1:
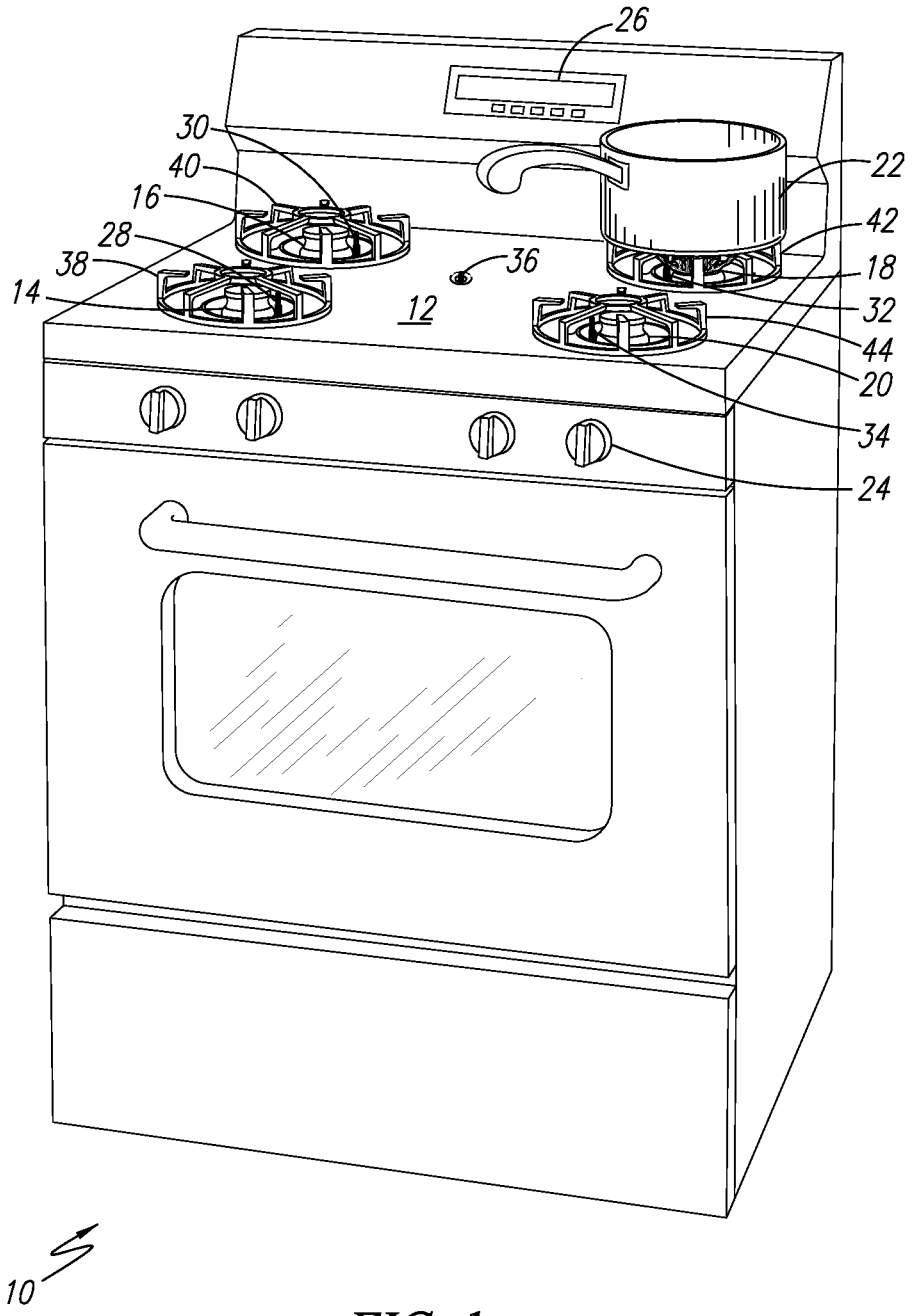
FIG. 1 is a perspective view of a gas range.

The present subject matter relates to cooking vessel detection on a cooktop. The present subject matter will now be described with reference to the drawings, wherein like reference numerals are used to refer to like elements throughout. It is to be appreciated that the various drawings are not necessarily drawn to scale from one figure to another nor inside a given figure, and in particular that the size of the components are arbitrarily drawn for facilitating the understanding of the drawings. In the following description, for purposes of explanation, numerous specific details are set forth in order to provide a thorough understanding of the present subject matter. It may be evident, however, that the present subject matter can be practiced without these specific details. Additionally, other embodiments of the subject matter are possible and the subject matter is capable of being practiced and carried out in ways other than as described. The terminology and phraseology used in describing the subject matter is employed for the purpose of promoting an understanding of the subject matter and should not be taken as limiting.

Radiated heat from an active burner on a cooktop will cause some degree of heating at remote portions of the cooktop (i.e., "cross heating"). The magnitude of such cross heating is greater when no cooking vessel is present at the active burner. Thus, the magnitude of the cross heating can be used to determine the presence or absence of a cooking vessel at an active burner. Temperature sensors can be located along the cooktop, remote from the active burner, to pick up the magnitude of the cross heating. The output of the temperature sensors can be monitored to determine whether a cooking vessel is present or absent from the active burner. If the cooking vessel is absent, the heat output (e.g., flame level) of the active burner can be automatically turned down to a low setting to conserve energy.

The active burner can have an adjacent temperature sensor for detecting the presence of a flame at the active burner. The remote temperature sensors can be adjacent other, inactive burners (i.e., located much closer to an inactive burner than the active burner). Thus, the remote temperature sensors can be used not only for determining the presence of a cooking vessel at an active burner, but also for flame detection at an adjacent burner when the adjacent burner is active. Cooktops already equipped with flame detection temperature sensors can be configured for cooking vessel detection via a firmware upgrade, without the need for additional temperature sensors. Alternatively, remote temperature sensors not associated with any particular burner can be used for cooking vessel detection. Further, signals from multiple temperature sensors can be compared to detect a malfunctioning temperature sensor.

Figure 2:
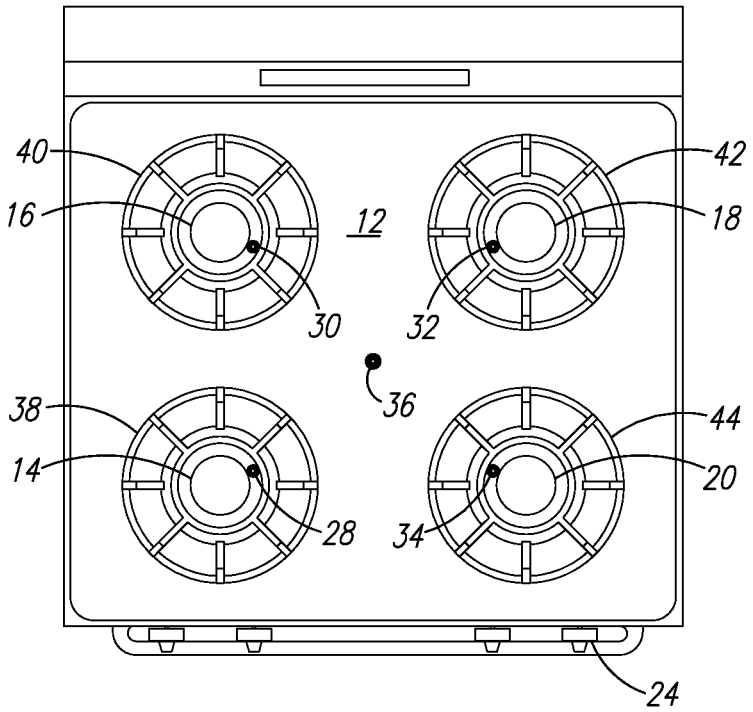
FIG. 2 is a schematic view of a cooktop.

FIG. 1 is a perspective view of a cooking appliance, such as a gas range 10 with a cooktop 12 and an oven cavity. FIG. 2 is a schematic view of the cooktop 12. The cooking appliance need not have an oven cavity and could be merely a cooktop or hot plate having one or more burners.

The cooktop 12 has burners 14, 16, 18, 20. The right front burner 20 has a cooking vessel 22 in FIG. 1 and is considered to be an active burner. The burners 14, 16, 18, 20 could be gas burners, electric heating elements, induction heaters, etc. However, the burners 14, 16, 18, 20 will be described herein in the context of a gas cooktop. Thus, the burners 14, 16, 18, 20 emit a flame for heating the cooking vessel 22 and any food products within the cooking vessel.

The gas range 10 includes a user interface device 24 for setting the flame level of a burner. As will be described in further detail with respect to FIG. 3, the user interface device 24 provides an input signal to an electronic controller for the cooktop 12, and the electronic controller adjusts the flame level based on the input signal, via an actuated gas valve. Example user interface devices 24 for controlling the heat output of the burners 14, 16, 18, 20 include rotary encoders, potentiometers, touch sensors, and the like. The user interface for the gas range can further include a display 26 for conveying information to the user, such as level/temperature settings, alarm conditions, etc.

The cooktop 12 shown in the figures has four burners 14, 16, 18, 20. However, it is to be appreciated that the cooktop 12 can include fewer or more than four burners. At least one of the burners can be configured as an "auto turn-down" burner, wherein the heat output or flame level of the burner is automatically reduced to a low level when the cooking vessel 22 is absent. Remote temperature sensors 28, 30, 34, 36 (i.e., temperature sensors not adjacent to the active burner) pick up the level of cross heating from the auto turn-down burner 18, and based on the level of cross heating, a controller in the gas range 10 can automatically downwardly adjust the flame level of the auto turn-down burner. When the cooking vessel 22 is placed on the auto turn-down burner 18, the level of cross heating will change, and this change can be observed by the controller. The controller can respond to the change in cross heating due to the presence of the cooking vessel 22 by upwardly adjusting the flame level back the level setting of the user interface device 24. The change in the cross heating could be a drop or reduction in cross heating due to the cooking vessel 22 blocking the conduction of heat from the auto turn-down burner to the remote temperature sensor. Alternatively, the change in cross heating could be an increase in cross heating due to the cooking vessel or cooktop structural elements increasing the conduction of heat from the auto turn-down burner to the remote temperature sensor.

Any of the burners 14, 16, 18, 20 can be configured as auto turn-down burners. Each burner 14, 16, 18, 20 can have an adjacent temperature sensor 28, 30, 32, 34. Thus, the temperature sensors 28, 30, 32, 34 can be adjacent one burner, but remote from the remaining burners. In certain embodiments, the cooktop 12 can include one or more additional temperature sensors 36 that are not adjacent any burner, but are remote from all of the burners 14, 16, 18, 20.

The temperature sensors 28, 30, 32, 34 that are adjacent burners can be used to determine the presence of a flame at the adjacent burner. The temperature sensors 28, 30, 32, 34 that are adjacent burners will output a much higher signal level when the adjacent burner is active, as compared to when a remote burner is active and the temperature sensor is warmed by cross heating. This difference in output can be exploited such that the temperature sensors 28, 30, 32, 34 can be used for both local flame detection and remote cooking vessel detection.

The temperature sensors 28, 30, 32, 34, 36 can be located to minimize their distance from one or more remote burners that are to be configured as auto turn-down burners. For example, as shown in FIG. 2, if all of the burners 14, 16, 18, 20 are to be configured as auto turn-down burners, the temperature sensors 28, 30, 32, 34, 36 can be positioned to generally face all of the other burners. Thus, the temperature sensors 28, 30, 32, 34, 36 are positioned toward the center of the cooktop 12. If only one burner is to be configured as an auto-turn down burner, then the temperature sensors 28, 30, 32, 34, 36 can be positioned toward that one burner.

Example temperature sensors include thermocouples, thermistors, infrared temperature sensors, etc. In an embodiment in which the temperature sensors 28, 30, 32, 34, 36 include thermocouples, at room temperature, the thermocouples can output approximately 1 mV. When an adjacent burner is set to a high flame level, the thermocouples can output approximately 16 mV. The thermocouples can output approximately 10-15 mV for lower flame levels at adjacent burners. The thermocouples can output approximately 2 mV when cross heated by a remote burner having a cooking vessel present at the remote burner. The thermocouples can output approximately 3-4 mV when cross heated by a remote burner having no cooking vessel present at the remote burner. Thus, by analyzing the signal levels from the various thermocouples (e.g., from at least two thermocouples—one adjacent an active burner and one remote from the active burner), both the presence of a flame at the active burner and the presence of a cooking vessel at the active burner can be determined.

Located at each burner 14, 16, 18, 20 is a cooking vessel support 38, 40, 42, 44. The cooking vessel supports 38, 40, 42, 44 can be burner grates for supporting a cooking vessel 22 at the burners. Each burner 14, 16, 18, 20 can have its own separate cooking vessel support as shown in FIG. 1, or an integral grate covering multiple burners can provide multiple cooking vessel supports. In certain embodiments, the cooking vessel supports 38, 40, 42, 44 or other structural elements of the cooktop can be configured to conduct heat from an auto turn-down burner to remote temperature sensors. Thus, the cooking vessel supports 38, 40, 42, 44 or other structural elements can provide a mechanical amplification of the heat transmitted to the remote temperature sensors.

Figure 3:
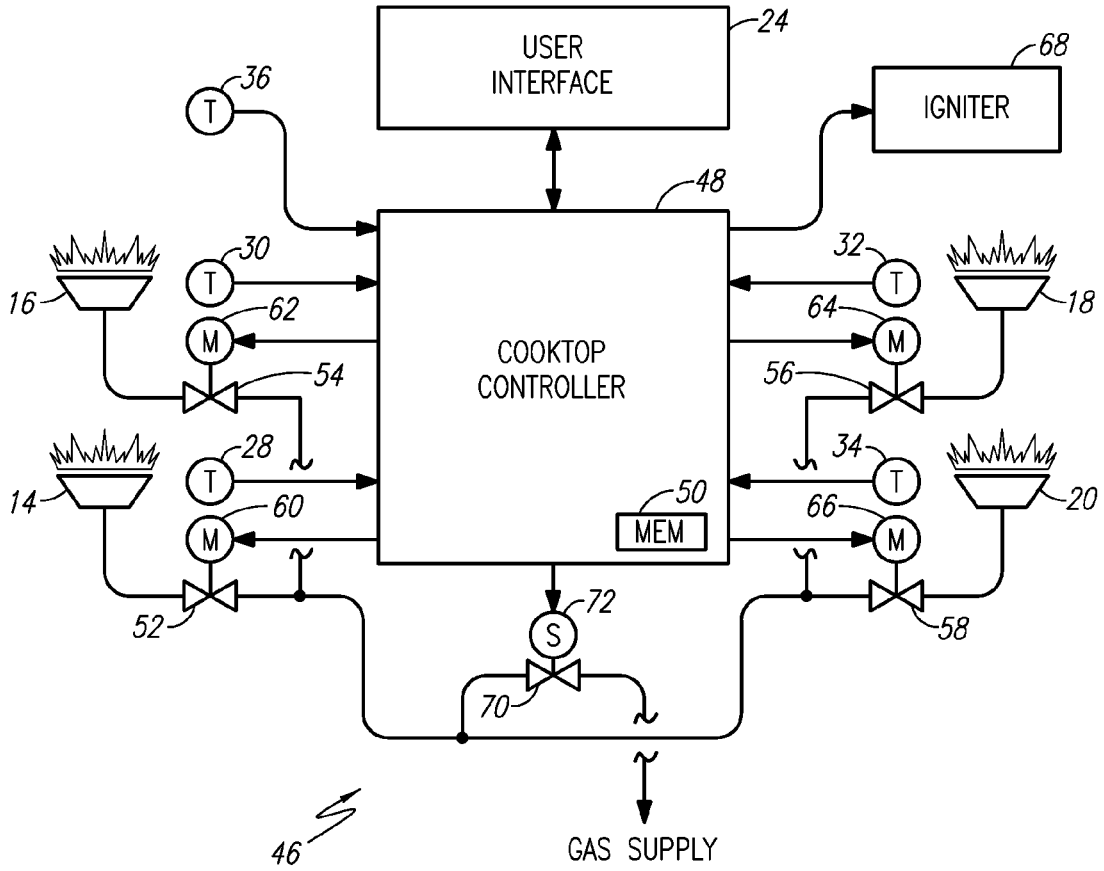
FIG. 3 is a schematic block diagram of a control system for the cooktop.

FIG. 3 provides a schematic diagram of a control system 46 for the gas range 10. The control system 46 includes a cooktop controller 48. The cooktop controller 48 can be an electronic controller and can include one or more processors. For example, the cooktop controller 48 can include one or more of a microprocessor, a microcontroller, a digital signal processor (DSP), an application specific integrated circuit (ASIC), a system on a chip (SoC), a field-programmable gate array (FPGA), discrete logic circuitry, or the like. The cooktop controller 48 can further include memory 50 and may store program instructions, configuration files, lookup tables, etc., that allow the cooktop controller 48 to provide the functionality ascribed to it herein. The memory 50 may include one or more volatile, non-volatile, magnetic, optical, or electrical media, such as read-only memory (ROM), random access memory (RAM), electrically-erasable programmable ROM (EEPROM), flash memory, or the like. The cooktop controller 48 can further include one or more analog-to-digital (A/D) converters for processing various analog inputs to the controller. The cooktop controller 48 can include multiple controllers or multiple control boards for distributed control functionality.

The cooktop controller 48 is operatively connected to the user interface 24, to receive a user's level settings for the burners 14, 16, 18, 20. In certain embodiments, the cooktop controller 48 can communicate bidirectionally with the user interface 24, which can allow the user interface to convey information received from the cooktop controller to the user. For example, the cooktop controller 48 can send status information, alarm information, etc. to the user interface 24, and the user interface can convey such information to the user visually and/or audibly.

The cooktop controller 48 is operatively connected to the temperature sensors 28, 30, 32, 34, 36 to receive temperature signals from the temperature sensors. For example, the cooktop controller 48 can receive analog signals, such as DC voltage signals, from the temperature sensors 28, 30, 32, 34, 36, wherein the levels of the analog signals correspond to the local temperatures at the temperature sensors. The cooktop controller 48 is programmed to correlate the signals received from the temperature sensors 28, 30, 32, 34, 36 with specific temperatures, through a lookup table or conversion algorithm, for example.

The cooktop includes flow control gas valves 52, 54, 56, 58 for controlling the flow of gas to each burner 14, 16, 18, 20. The heat output (e.g., flame level) of each burner 14, 16, 18, 20 can be adjusted by operating the appropriate gas valve 52, 54, 56, 58. Each gas valve 52, 54, 56, 58 is operatively connected or coupled to a valve actuator 60, 62, 64, 66 that operates the valve and to adjust the flow of gas through the valve. An example valve actuator is an electric motor, such as a stepper motor. The cooktop controller 48 is operatively connected to each valve actuator 60, 62, 64, 66 to control the operations of the valve actuators. Accordingly, the cooktop controller 48 can individually adjust the gas flow through each gas valve 52, 54, 56, 58 by controlling the movements of the actuators 60, 62, 64, 66, and, thus, control the heat output (e.g., flame level) of each burner 14, 16, 18, 20. For example, if the valve actuators 60, 62, 64, 66 are stepper motors, the cooktop controller 48 can provide a series of pulses to the stepper motors to control the flow of gas through the gas valves 52, 54, 56, 58 and to the burners 14, 16, 18, 20. The cooktop controller 48 can be directly connected to the valve actuators 60, 62, 64, 66 or indirectly connected to the valve actuators, such as through interposing electronic switches or relays for example. The cooktop controller 48 can control the heat output from the burners 14, 16, 18, 20 based on the level settings received from the user via the user interface 24. Further, the cooktop controller 48 can implement the auto turn-down functionality described herein via its control of the gas valves 52, 54, 56, 58.

In certain embodiments, the burners can be electric heating elements or induction heaters, and the cooktop controller 48 can electronically control the heat output of such burners, such as via pulse width modulation techniques, for example.

The cooktop controller 48 can activate the burners 14, 16, 18, 20 so that they are turned ON or ignited. The control system 46 can include an igniter 68, such as a spark igniter, to ignite the burners, and the cooktop controller 48 can be operatively connected to the igniter to control its operations and activate the burners.

The control system 46 for the gas range can further include a main shut-off valve 70 for shutting off the flow of gas to all of the burners 14, 16, 18, 20. One side of the main shut-off valve 70 is connected to a gas supply line, and the other side of the main shut-off valve 70 can be connected to a manifold to supply gas to all of the burners 14, 16, 18, 20. A valve operator 72, such as a solenoid, is operatively connected to the main shut-off valve 70 to control its operations. The main shut-off valve 70 can be a normally closed valve that is opened when the valve operator 72 is energized. The cooktop controller 48 can be operatively connected to the valve operator 72 to control the operations of the valve operator 72 and valve. When the cooktop controller 48 activates a burner, it monitors the temperature signal from temperature sensor adjacent the burner. The cooktop controller 48 can determine the presence of a flame at the active burner from the level of the temperature signal. If a flame is not detected, due to a malfunctioning igniter for example, the cooktop controller 48 can shut off the gas to all of the burners 14, 16, 18, 20 via the main shut-off valve 70.

Since the cooktop controller 48 controls the operations of the burners and their gas valves, the cooktop controller 48 knows which burners are active and which burners are inactive. The cooktop controller 48 can determine whether or not a cooking vessel is absent from the active burner, based on the levels of temperature signals from temperature sensors adjacent inactive burners or other remote temperature sensors (e.g., temperature sensor 36). As discussed above, radiated heat from the active burner will result in cross heating of the remote temperature sensors. The magnitude of the cross heating is greater when no cooking vessel is present at the active burner. Thus, based on the level of the temperature signals from the remote temperature sensors, the cooktop controller 48 can determine whether a cooking vessel is absent at the active burner. If the cooktop controller 48 determines that a cooking vessel is absent from the active burner, it can automatically downwardly adjust the gas flow and flame level at the active burner. The gas flow is automatically downwardly adjusted from a flow level corresponding to the user's desired flame level setting, which is input through the user interface 24. When the cooking vessel is no longer absent from the active burner, the cross heating of the remote temperature sensors will change (e.g., drop), and a corresponding change in temperature can be observed by the cooktop controller 48 via the temperature signals from the remote temperature sensors. The cooktop controller 48 can determine the presence of the cooking vessel at the active burner and automatically upwardly adjust the gas flow level and flame level of the active burner to the user's desired flame level setting. The automatic upward adjustment of the gas flow occurs after an auto turn-down event (i.e., after determining the absence of the cooking vessel and automatically reducing the heat output of the active burner).

The degree to which a remote temperature sensor is warmed by cross heating from an active burner will be determined by the flame level setting of the active burner and the physical configuration of the cooktop. For a particular style or model of cooktop, experiments can be conducted to establish expected signal levels from remote temperature sensors during cross heating, with and without a cooking vessel present at an active burner, for various different flame level settings. Calibration of the control system 46 can be accomplished by a configuration file that details cooktop size, mounting location of each temperature sensor and/or burner, and other information pertaining to the configuration of the cooktop. The configuration file can be created based on the experimental data regarding cross heating that is obtained for the particular style or model of cooktop. Different models or styles of cooktop will thus utilize different calibration files obtained from experimental data. The configuration file can be stored in the memory 50 of the cooktop controller 48 for use by the controller during operation of the cooktop.

In certain embodiments, the cooktop controller 48 can determine whether a temperature sensor 28, 30, 32, 34, 36 has failed, based on the difference between the temperature signal from the failed temperature sensor and temperature signals from one or more other temperature sensors. For example, if the signal level from one remote temperature sensor is substantially different from one or more other remote temperature sensors, the cooktop controller 48 can determine that a temperature sensor malfunction has occurred. The cooktop controller 48 can then output an appropriate alarm signal to the user interface 24. Also, if a burner is active, the cooktop controller 48 can expect a certain range of signal levels from the remote temperature sensors based on the configuration file. If the signal level from a remote temperature sensor is outside of the expected range, the cooktop controller 48 can determine that a temperature sensor malfunction has occurred and generate an appropriate alarm.

Figure 4:
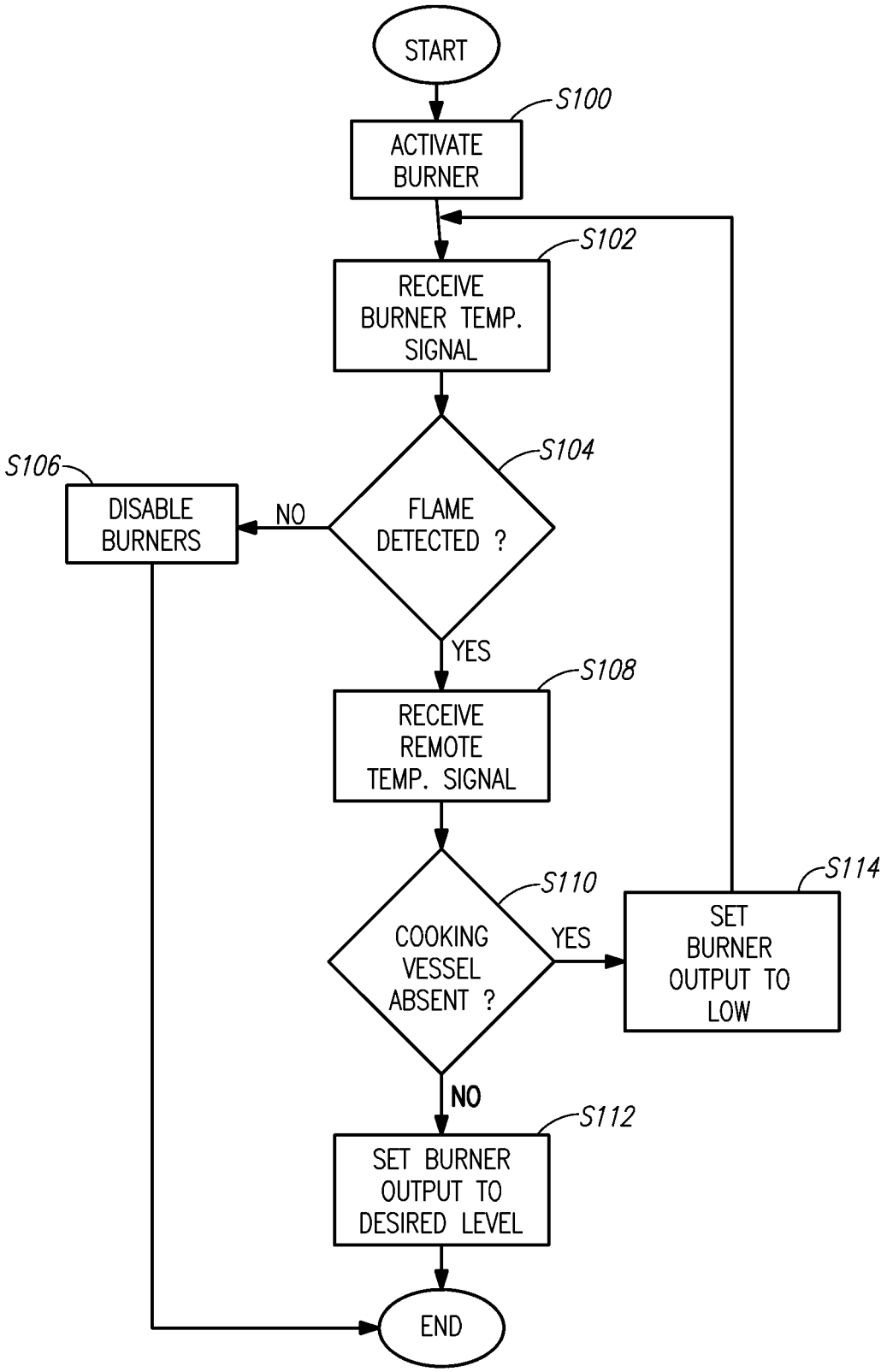
FIG. 4 is a flow diagram.

FIG. 4 provides a flow diagram for an example burner auto turn-down method. A burner is activated by the cooktop controller (step S100), and the cooktop controller receives a temperature signal from a temperature sensor adjacent the active burner (step S102). From the temperature signal of the temperature sensor adjacent the active burner, the cooktop controller can detect whether or not a flame has been established at the active burner (step S104). If no flame is detected, the cooktop controller can disable the burners (step S106) by operating the main shut-off valve. If a flame is detected, the cooktop controller can receive and monitor temperature signals from temperature sensors remote from the active burner (step S108). Based on the levels of the temperature signals from the remote temperature sensors, the cooktop controller can determine whether a cooking vessel is present or absent from the active burner (step S110). If the cooking vessel is present at the active burner, the heat output of the active burner will be set to the desired level (step S112), as established by the user. If the cooking vessel is absent from the active burner, the cooktop controller can downwardly adjust the heat output of the active burner to a low level (step S114). The low level can remain in effect until the presence of a cooking vessel at the active burner is subsequently detected by the cooktop controller.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A cooktop, comprising:

a first burner;

a second burner;

a first temperature sensor adjacent the first burner;

a second temperature sensor adjacent the second burner; and a cooktop controller operatively connected to the first temperature sensor to receive a first temperature signal from the first temperature sensor, and operatively connected to the second temperature sensor to receive a second temperature signal from the second temperature sensor, wherein the cooktop controller is configured to determine, from the second temperature signal, an absence of a cooking vessel at the first burner, and to automatically downwardly adjust a heat output of the first burner based on the absence of a cooking vessel at the first burner.

2. The cooktop of claim 1, wherein:

the first and second burners are gas burners, and the cooktop controller is further configured to determine a presence of a flame at the first burner from the first temperature signal, and to determine a presence of a flame at the second burner from the second temperature signal.

3. The cooktop of claim 2, wherein the cooktop controller is further configured to determine, from the first temperature signal, an absence of a cooking vessel at the second burner, and to automatically downwardly adjust a heat output of the second burner based on the absence of a cooking vessel at the second burner.

4. The cooktop of claim 1, wherein the first and second burners are gas burners, the cooktop further comprising:

a user interface device operatively connected to the cooktop controller for inputting a level setting for the first burner to the cooktop controller, wherein the heat output of the first burner is automatically downwardly adjusted from the level setting based on the absence of a cooking vessel at the first burner, and subsequently automatically upwardly adjusted to the level setting by the cooktop controller based on a determination that a cooking vessel is not absent at the first burner, wherein the determination that a cooking vessel is not absent at the first burner is made by the cooktop controller based on the second temperature signal.

5. The cooktop of claim 4, wherein the cooktop controller is further configured to determine a presence of a flame at the first burner from the first temperature signal.

6. The cooktop of claim 1, further comprising:

a third burner; and a third temperature sensor adjacent the third burner, wherein the cooktop controller is operatively connected to the third temperature sensor to receive a third temperature signal from the third temperature sensor, and configured to determine a temperature sensor malfunction from a difference between the second temperature signal and the third temperature signal.

7. The cooktop of claim 6, wherein the cooktop controller is further configured to determine a presence of a flame at the first burner from the first temperature signal, a presence of a flame at the second burner from the second temperature signal, and a presence of a flame at the third burner from the third temperature signal.

8. A cooktop, comprising:

a first gas burner;

a second gas burner;

a first temperature sensor adjacent the first gas burner;

a second temperature sensor adjacent the second gas burner such that the second temperature sensor is closer to the second gas burner than the first gas burner;

a first cooking vessel support for supporting a cooking vessel at the first gas burner;

a first gas valve for controlling a first gas flow through the first gas valve to the first gas burner;

a first valve actuator operatively connected to the first gas valve and configured to adjust the first gas flow through the first gas valve; and a programmable cooktop controller operatively connected to the first temperature sensor to receive a first temperature signal from the first temperature sensor, operatively connected to the second temperature sensor to receive a second temperature signal from the second temperature sensor, and operatively connected to the first valve actuator to control operations of the first valve actuator, wherein the programmable cooktop controller is programmed to:

determine a presence of a flame at the first gas burner from a level of the first temperature signal, determine a presence of a flame at the second gas burner from a level of the second temperature signal, determine an absence of a cooking vessel at the first gas burner from the level of the second temperature signal, and automatically downwardly adjust the first gas flow to the first gas burner based on the absence of a cooking vessel at the first gas burner.

9. The cooktop of claim 8, wherein the programmable cooktop controller is further programmed to determine a temperature sensor malfunction.

10. The cooktop of claim 8, further comprising a second cooking vessel support for supporting a cooking vessel at the second gas burner;

a second gas valve for controlling a second gas flow through the second gas valve to the second gas burner; and a second valve actuator operatively connected to the second gas valve and configured to adjust the second gas flow through the second gas valve, wherein the programmable cooktop controller is operatively connected to the second valve actuator to control operations of the second valve actuator, and the programmable cooktop controller is programmed to determine an absence of a cooking vessel at the second gas burner from the level of the first temperature signal, and to automatically downwardly adjust the second gas flow to the second gas burner based on the absence of a cooking vessel at the second gas burner.

11. The cooktop of claim 8, further comprising a user interface device operatively connected to the programmable cooktop controller for inputting a flame level setting for the first gas burner to the programmable cooktop controller, wherein the first gas flow to the first gas burner is automatically downwardly adjusted from a flow level corresponding to the flame level setting, based on the absence of a cooking vessel at the first gas burner, and subsequently automatically upwardly adjusted to the flow level corresponding to the flame level setting by the programmable cooktop controller based on a determination that a cooking vessel is not absent at the first gas burner, wherein the determination that a cooking vessel is not absent at the first gas burner is made by the programmable cooktop controller based on the second temperature signal.

12. The cooktop of claim 8, further comprising a third temperature sensor, wherein:

the first temperature sensor is closer to the first gas burner than is the third temperature sensor, the programmable cooktop controller is operatively connected to the third temperature sensor to receive a third temperature signal from the third temperature sensor, and the programmable cooktop controller is programmed to determine a temperature sensor malfunction from a difference between the level of the second temperature signal and a level of the third temperature signal while the first gas burner operates.

13. The cooktop of claim 12, further comprising a third gas burner, wherein the third temperature sensor is adjacent the third gas burner.

14. A cooktop burner control method, comprising the steps of:

activating a first burner of the cooktop;

receiving a first temperature signal from a first temperature sensor adjacent the first burner;

receiving a second temperature signal from a second temperature sensor, the second temperature sensor being remote from the first burner;

determining whether a cooking vessel is absent from the first burner based on a level of the second temperature signal; and automatically downwardly adjusting a heat output of the first burner based on absence of a cooking vessel from the first burner.

15. The method of claim 14, wherein the step of activating the first burner includes igniting a gas flow from the first burner.

16. The method of claim 15, further comprising the step of determining a presence of a flame at the first burner based on a level of the first temperature signal.

17. The method of claim 15, further comprising the steps of:

determining a presence of a flame at a second burner adjacent the second temperature sensor, based on the level of the second temperature signal;

determining whether a cooking vessel is absent from the second burner based on a level of the first temperature signal; and automatically downwardly adjusting a flame level of the second burner based on absence of a cooking vessel from the second burner.

18. The method of claim 14, further comprising the steps of:

receiving a level setting for the first burner from a user interface device; and subsequent to automatically downwardly adjusting the heat output of the first burner, automatically upwardly adjusting the heat output of the first burner to the level setting upon determining that a cooking vessel is not absent from the first burner, wherein the determining that a cooking vessel is not absent from the first burner is based on the level of the second temperature signal.

19. The method of claim 14, further comprising the steps of:

receiving a third temperature signal from a third temperature sensor, the third temperature sensor being remote from the first burner; and determining a temperature sensor malfunction based on a difference between the level of the second temperature signal and a level of the third temperature signal.

20. The method of claim 19, further comprising the steps of:

determining a presence of a flame at the first burner based on a level of the first temperature signal;

determining a presence of a flame at a second burner adjacent the second temperature sensor, based on the level of the second temperature signal; and determining a presence of a flame at a third burner adjacent the third temperature sensor, based on the level of the third temperature signal.

* * * * *